US011217897B1

(12) United States Patent
West et al.

(10) Patent No.: US 11,217,897 B1
(45) Date of Patent: Jan. 4, 2022

(54) ANTENNA SYSTEM AND METHOD WITH A HYBRID BEAMFORMER ARCHITECTURE

(71) Applicant: Rockwell Collins, Inc., Cedar Rapids, IA (US)

(72) Inventors: James B. West, Cedar Rapids, IA (US); Michael L. Hageman, Mount Vernon, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 152 days.

(21) Appl. No.: 16/123,854

(22) Filed: Sep. 6, 2018

(51) Int. Cl.

| | |
|---|---|
| ***H01Q 21/00*** | (2006.01) |
| ***H01Q 3/38*** | (2006.01) |
| ***H01Q 3/40*** | (2006.01) |
| ***H01Q 21/06*** | (2006.01) |
| ***H01Q 21/22*** | (2006.01) |

(52) U.S. Cl.
CPC ..... *H01Q 21/0025* (2013.01); *H01Q 3/385* (2013.01); *H01Q 3/40* (2013.01); *H01Q 21/0006* (2013.01); *H01Q 21/061* (2013.01); *H01Q 21/065* (2013.01); *H01Q 21/22* (2013.01)

(58) Field of Classification Search
CPC ..... H01Q 21/0006; H01Q 21/0025; H01Q 21/061; H01Q 21/065; H01Q 3/385; H01Q 3/2694; H01Q 3/2688
See application file for complete search history.

(56) References Cited

U.S. PATENT DOCUMENTS

| | | | | |
|---|---|---|---|---|
| 8,903,342 | B1 | 12/2014 | Wyse et al. | |
| 8,907,817 | B1 | 12/2014 | Finley et al. | |
| 9,116,244 | B1 | 8/2015 | West et al. | |
| 9,391,375 | B1 * | 7/2016 | Bales | H01Q 21/24 |
| 9,478,858 | B1 | 10/2016 | West et al. | |
| 9,653,820 | B1 | 5/2017 | West et al. | |
| 9,667,235 | B1 | 5/2017 | Wyse et al. | |
| 9,705,611 | B1 * | 7/2017 | West | H04B 17/12 |
| 9,735,469 | B1 | 8/2017 | West et al. | |
| 2006/0256016 | A1 * | 11/2006 | Wu | H01Q 21/065 343/700 MS |
| 2008/0037687 | A1 * | 2/2008 | Li | G01S 19/33 375/316 |

(Continued)

OTHER PUBLICATIONS

R.J. Mailloux, Antenna Arrav Architecture, Proceedings of the IEEE, vol. 80(1), p. 163-172, Jan. 1992 (Year: 1992).*

(Continued)

*Primary Examiner* — Bernarr E Gregory
*Assistant Examiner* — Fred H Mull
(74) *Attorney, Agent, or Firm* — Suiter Swantz pc llo

(57) ABSTRACT

An antenna system and method use an electronically-scanned antenna array and a hybrid beam former architecture. The antenna system includes a matrix of antenna elements and a feeder network. The feeder network includes a first layer including phase shifters. Each of the phase shifters is for a respective antenna element of the antenna elements. The feeder network also includes a second layer and a third layer. Each of the first set of the first time delay units in the second layer is for a respective first subarray of the first subarrays of the antenna elements. Each of the second set of the second time delay units in the third layer is for a respective second subarray of the second subarrays of the first subarrays.

19 Claims, 4 Drawing Sheets

(56) References Cited

U.S. PATENT DOCUMENTS

| | | | | |
|---|---|---|---|---|
| 2016/0172755 | A1* | 6/2016 | Chen | H01Q 21/0025 342/371 |
| 2017/0054221 | A1 | 2/2017 | West et al. | |
| 2017/0077610 | A1* | 3/2017 | Bongard | H01Q 21/24 |
| 2018/0248263 | A1* | 8/2018 | Petersson | H01Q 21/065 |
| 2019/0253125 | A1* | 8/2019 | Apaydin | H01Q 21/061 |
| 2020/0021039 | A1* | 1/2020 | Pelletti | G01S 13/04 |

OTHER PUBLICATIONS

T.C. Cheston et al., Time-Delay Feed Architectures for Active Scanned Arrays, IEEE Antennas and Propagation Society International Symposium, p. 1620-1623, 1996 (Year: 1996).*
U.S. Appl. No. 14/300,021, filed Jun. 9, 2014, West et al.
U.S. Appl. No. 15/825,711, filed Nov. 29, 2017, West et al.
U.S. Appl. No. 16/008,983, filed Jun. 14, 2018, West et al.

* cited by examiner

ANTENNA SYSTEM AND METHOD WITH A HYBRID BEAMFORMER ARCHITECTURE

BACKGROUND

Embodiments of inventive concepts disclosed herein relate generally to antenna systems including but not limited to antenna systems including steerable arrays.

Modern sensing and communication systems may utilize various types of antennas to provide a variety of functions, such as communication, radar, and sensing functions. For example, ultra-high frequency (UHF) and very high frequency (VHF) radio systems use directional and omnidirectional antenna arrays for data and voice communication. In another example, radar systems use antenna arrays to perform functions including but not limited to: sensing, intelligence-gathering (e.g., signals intelligence, or SIGINT), direction finding (DF), electronic countermeasure (ECM) or self-protection (ESP), electronic support (ES), electronic attack (EA) and the like. An antenna system that supports multiple, independently steered beams is desirable for military and commercial radio frequency (RF) sensor systems. Electrically large, multiple, independently steered, analog beam formers (ABF), that steer the beam of an active electronically scanned array (AESA) are challenging to implement in hardware due the banking of parallel and independently steered beam manifolds and the size of time delay units.

SUMMARY

In one aspect, embodiments of the inventive concepts disclosed herein are directed to an antenna system with a hybrid beam former architecture. The antenna system includes a matrix of antenna elements and a feeder network. The feeder network includes a first layer including phase shifters. Each of the phase shifters is for a respective antenna element of the antenna elements. The feeder network also includes a second layer and a third layer. The second layer includes a first set of first time delay units associated with first subarrays of the antenna elements. Each of the first set of the first time delay units is for a respective first subarray of the first subarrays of the antenna elements. The third layer includes a second set of second time delay units associated with second subarrays. Each of the second set of the second time delay units is for a respective second subarray of the second subarrays of the first subarrays.

In a further aspect, embodiments of the inventive concepts disclosed herein are directed to a system for steering an antenna array. The system includes a beam steering computer, and a hierarchical layered feeder network. The hierarchical layered feeder network includes a first level including phase shifters, a second level and a third level. Each of the phase shifters is for a respective antenna element of the antenna elements. The second level includes a first set of first time delay units associated with first subarrays of the antenna elements, and each first time delay unit of the first set of the first time delay units is for a respective first subarray of the first subarrays of the antenna elements. The third level includes a second set of second time delay units associated with second subarrays. Each of the second time delay units of the second set of the second time delay units is for a respective second subarray of the second subarrays of the first subarrays.

In a further aspect, embodiments of the inventive concepts disclosed herein are directed to a method of beam forming using an electronically scanned antenna array. The method includes providing phase shift commands to phase shifters respectively coupled to antenna elements of the electronically scanned antenna array, and providing first time delay commands to first time delay units. Each of the first time delay units are associated with a respective first set of the antenna elements. The method also includes providing second time delay commands to second time delay units. Each of the second time delay units are associated with a second set of first sets of the antenna elements.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or maybe represented schematically in the interest of clarity. Like reference numerals in the drawings may represent and refer to the same or similar element, feature, or function. In the drawings.

DETAILED DESCRIPTION

Figure 1:
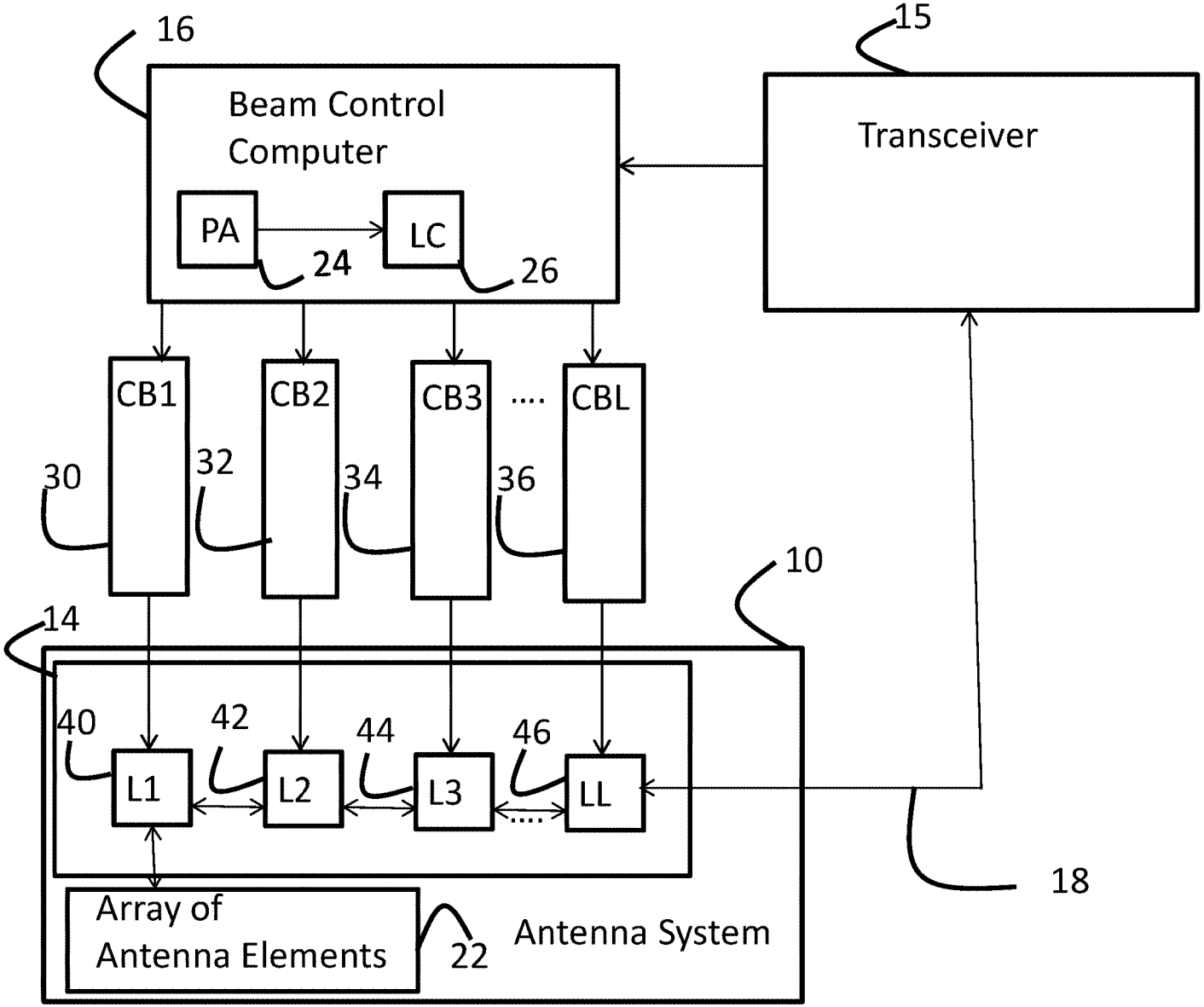
FIG. 1 is a general block diagram of an antenna system coupled to a transceiver and a beam control computer according to exemplary aspects of the inventive concepts disclosed herein.

Before describing in detail embodiments of the inventive concepts disclosed herein, it should be observed that the inventive concepts disclosed herein include, but are not limited to a novel structural combination of components and circuits disclosed herein, and not to the particular detailed configurations thereof. Accordingly, the structure, methods, functions, control and arrangement of components and circuits have, for the most part, been illustrated in the drawings by readily understandable block representations and schematic diagrams, in order not to obscure the disclosure with structural details which will be readily apparent to those skilled in the art, having the benefit of the description herein. Further, the inventive concepts disclosed herein are not limited to the particular embodiments depicted in the diagrams provided in this disclosure, but should be construed in accordance with the language in the claims.

Some embodiments of the inventive concepts disclosed herein are directed to an aperture for use in the very high frequency (VHF) or ultra-hich frequency (UHF) band to the W band. In some embodiments, systems and methods independently steer multiple beams using phase shifters and time delay units using hardware that can be implemented without being significantly limited by size, weight, power and cost (SWAP-C) considerations. In some embodiments, analog beam forming and digital beam forming techniques (hybrid techniques) are utilized at different feeder levels to steer multiple, independent beams. In some embodiments, a multi-beam hierarchical beam former architecture exploits the attributes of analog modulo-360 degree phase shifter, true time delay and digital beam forming (both digital delay and digital phase concepts) in a common beam former architecture to optimize SWAP-C against performance. In some embodiments, the systems and methods are utilized in UUWB signal intelligence (SIGINT) receiver systems and/or other advanced radio and radar systems.

In some embodiments, the aperture is provided with a feed array with a first level having phase shifters and subsequent levels having time delay units that can be more easily manufactured. In some embodiments, each of the levels includes a summer for implementing a hierarchical architecture. In some embodiments, the antenna array includes N antenna elements (N is an integer) and the feeder network includes M levels (M is an integer). A phase shifter is provided for each of the N antenna elements at the first level (L=1), and the each subsequent level provides a time delay unit for $N/(4*(L-1)^2)$ sets of the $4*(L-1)^2$ antenna elements. The number of the antenna elements associated with each time delay unit in the level equals $4(L-1)^2$ in some embodiments. In some embodiments, levels after L=3 do not include time delay units. The formulas above are exemplary only; other formulas and reduction factors can be utilized for the architecture, and the formula can change based upon level.

Referring to FIG. 1, an antenna system 10 for a communication, radar, or sensing system includes an antenna array 22 and an antenna feed network 14. The antenna feed network 14 includes feeder levels 40, 42, 44, and 46 (e.g., from 1 to L) which are hierarchically arranged in some embodiments. The antenna system 10 is coupled to a transceiver 15 via a signal line 18 and a beam control computer via a set of control busses 30, 32, 34, and 36. The signal line 18 can represent multiple signal lines.

In some embodiments, the antenna system 10 is for a sensing radar system or electronic warfare radar system. The antenna system 10 includes an array 22 of antenna elements configured or a 15-60 gigahertz operation using miniature and high density RFIC packaging and interconnects appropriate for 60 gigahertz half wavelength in some embodiments. In some embodiments, hardware embodiments are optimized in a non-uniform fashion for subarrays of the antenna array 22.

The antenna system 10 configured as a multiple channel system can simultaneously steer multiple radio frequency (RF) beams in some embodiments. The antenna array 22 is a two-dimensional array, a single dimensional array or three dimensional array in some embodiments. The antenna system 10 is utilized to point electronically at angles in two-dimensional; space by means of 1D or 2D electronic scanning. The antenna system 10 includes various components including power amplifiers, low noise amplifiers, phase shifters, transmit/receive switches, temperature sensing equipment, radio frequency (RF) power and phase delay sensing components, splitters, summers, time delay units, and digital and analog control busses in some embodiments. In some embodiments, the antenna array 22 is a square, prism shaped, rectangular, hexagonal, pentagonal, circular, cylindrical, spherical, etc. and is flat or arbitrarily curved surface, conformal to a vehicle surface, etc.

The transceiver 15 can be provided on one or more RF integrated circuits, or modules in one embodiment. The transceiver 15 can comprised of a block up/down converter, an analog-to-digital converter/digital-to-analog converter circuit, and a processor. The transceiver 15 can be a receiver only, transmitter only, or both a transmitter/receiver. Transceiver 15 can be embodied as a hard wired circuit, ASIC, programmable logic device, processor or combination thereof. In some embodiments, multiple channel synthesizers can be utilized to remove settling times/transient phase noise in fast tuning transceiver systems. Generally, increasing the number of synthesizers or transceivers 15 decreases the tuning speed in some embodiments.

The beam control computer 16 is a software module operating on a computer platform or processor, an ASIC, a programmable logic device, a hardware circuitry, or a mixture of thereof. In some embodiments, the set of phase or time delay commands are provided in response to a beam pointing angle parameter and a frequency parameter. In some embodiments, the set of the set of phase or time delay commands are provided in response to a beam pointing angle parameter, an environmental parameter, and a frequency parameter. The beam steering computer 16 also selects the number of beams that may be activated by digital beam forming within a given layer or feeder level 40, 42, 44, and 46.

The beam control computer 16 is provided within transceiver 15, antenna system 10 and/or as a discrete system. The antenna system 10 can be or can be part of a sensing system, radar system, and communication system. In one embodiment, antenna system 10 can be part of an electronic intelligence (ELINT) receiver, an electronic countermeasure (ECM) system, an electronic support measure (ESM) system, and/or hybrids thereof.

In some embodiments, the antenna system 10 (e.g., the antenna feed network 14) can employ multi-chip modules discussed in U.S. application Ser. No. 13/760,964 filed Feb. 6, 2013, now U.S. Pat. No. 8,907,817, Ser. No. 13/781,449, filed Feb. 28, 2013, now U.S. Pat. No. 9,116,244 and Ser. No. 13/837,934 filed Mar. 15, 2013, now U.S. Pat. No. 9,478,858, all of which are incorporated herein by reference in their entireties. In some embodiments, the antenna system 10 can include components described in U.S. application Ser. No. 13/714,209 filed Dec. 13, 2012, now U.S. Pat. No. 9,667,235, and Ser. No. 13/737,777 filed Jan. 9, 2013, now U.S. Pat. No. 8,903,342, both incorporated herein by reference in their entireties. In some embodiments, digital beam forming operations are performed in the feeder layers 40, 42, 44, and 46. The feeder levels 40, 42, 44, and 46 include analog to digital and digital to analog converters and digital processors for providing the digital beam forming instead of analog beam forming components in some embodiments.

The feeder levels 40, 42, 44, and 46 include components for time delaying or phase shifting the signals received by the antenna array 22 and for summing the signals for reception on the signal line 18. The feeder levels 40, 42, 44, and 46 include components for frequency conversion, analog-to-digital conversion, amplification, analog beam forming, digital beam forming (e.g., direct I/Q sampled RF signal or ADC I/Q sampling after intermediate frequency (IF)), polarization synthesis networks, and filters. Each of the feeder levels 40, 42, 44, and 46 includes different components for implementing different types of beamforming and processing. Time delay/phase shift/digital beam forming can be generally applied within a generalized number of the levels 40, 42, 44, and 46 in the hierarchical architecture.

The term feeder level refers generically to circuitry organized in a particular layer or level. The term is not restricted to placing components on particular physical level of a circuit board or at a particular physical level of vertical structure. The number of feeder levels discussed and shown is exemplary only; the integer L (e.g., 3, 4, 5, 6, 7, . . . 10) can be any number depending on design criteria and system parameters.

The feeder levels 40, 42, 44 and 46 receive phase shift or time delay commands via respective control buses 30, 32, 34 and 36. The control buses 30, 32, 34 and 36 can be analog or digital control buses for providing a beam steering command to the feeder levels 40, 42, 44 and 46. The beam control computer 16 includes a phase angle or time delay module 24 for determining an appropriate beam steering command for an appropriate beam steering angle. A level control module 26 determines the appropriate phase shift or time delay for each of the levels 40, 42, 44 and 46 in response to the appropriate beam steering command from the phase angle module 24. The phase angle module 24 and the level control module 26 can be software or hardware modules, or combinations thereof configured to provide the appropriate phase control commands. If a given feeder layer or level performs digital beam forming, that feeder level receives digital control signals in some embodiments. In addition, control signals for amplitude control for element electronic gain adjustment to enable amplitude tapering for radiation pattern synthesis can be provided to the feeder levels 40, 42, 44 and 46. The feeder levels 40, 42, 44 and 46 can include variable gain amplifiers for effecting the amplitude adjustments.

The phase shift or time delay commands can be can be provided by the beam control computer 16 in accordance with the techniques described in U.S. application Ser. No. 14/300,021, filed Jun. 19, 2014 and incorporated herein by reference in its entirely. The level control module 26 determines the appropriate amount required by each of the feeder levels 40, 42, 44 and 46 to implement the beam steering command. A lookup table, or algorithm can be used to calculate the amount of time delay or phase shift at each level for implementing the time delay or phase shift at the array of antenna elements 49. The control busses 30, 32, 34 and 36 include one or multiple conductors. The control bus 30 includes at least one conductor for controlling each of the antenna elements in the array 22 while the control buses 32, 34, and 36 require progressively fewer conductors to control the sets of antenna elements associated with the respective levels 42, 44, and 46. In some embodiments, the processing for feeder levels 40, 42, 44 and 46 is performed by a single computer or by distributed processors residing within each of the respective layers of the hierarchical beam former.

Figure 2:
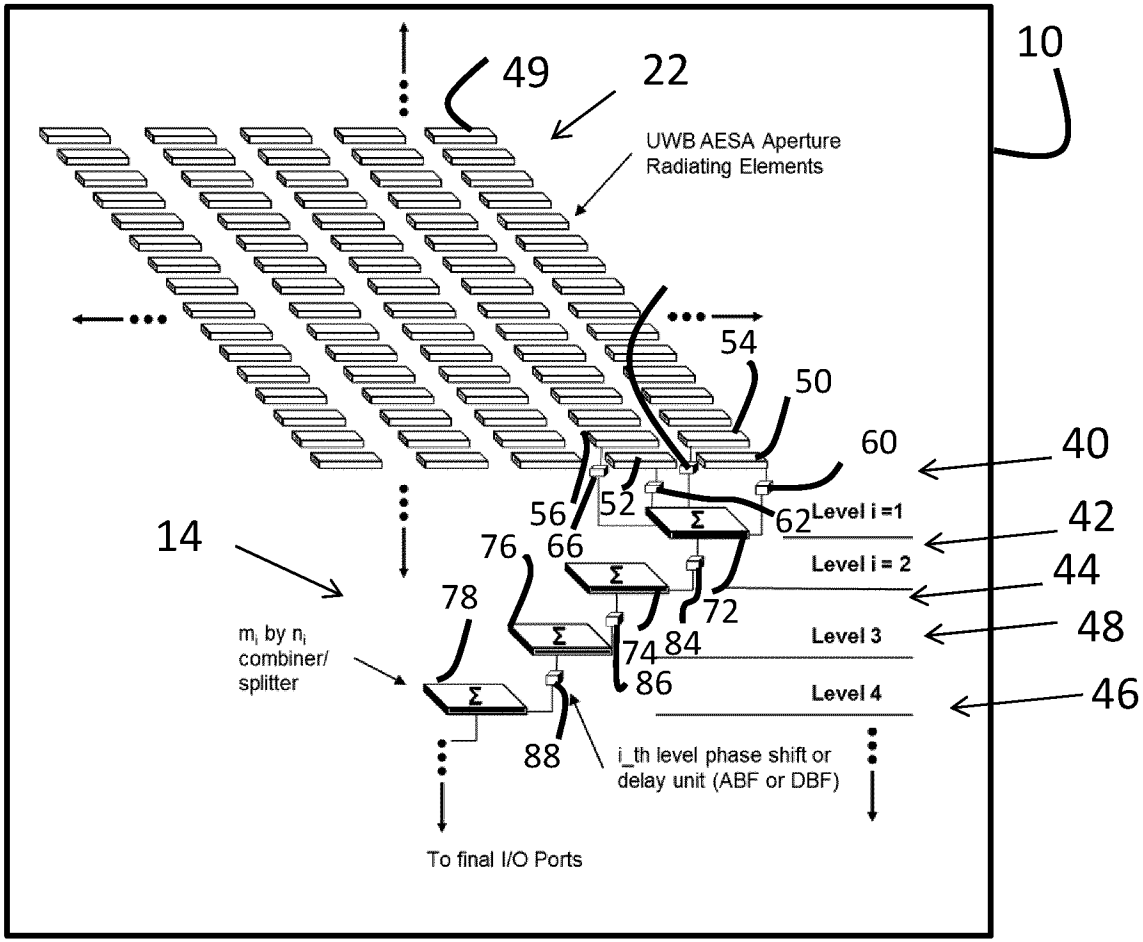
FIG. 2 is a partial exploded perspective view schematic drawing of the antenna system illustrated in FIG. 1 according to exemplary aspects of the inventive concepts disclosed herein.

With reference to FIG. 2, the antenna system 10 includes antenna elements 49 as part of the array 22. The feeder levels 40, 42, 44, 48, and 46 are arranged hierarchically and are coupled to the antenna elements 49 of the array 22 with each successive feed level being associated with larger subarrays or groups of the antenna elements 49. FIG. 2 is shown as a partial schematic drawing for simplicity, where the association of each and every element with each of the levels 42, 44, 48, and 46 of the feed network 14 is not shown for simplicity and all of the antenna elements 49 are not shown for simplicity. In some embodiments, the hybrid beam former for the antenna system 10 can be used with various apertures and can be applied to different classes of UWB and UUWB aperture configurations.

Figure 3:
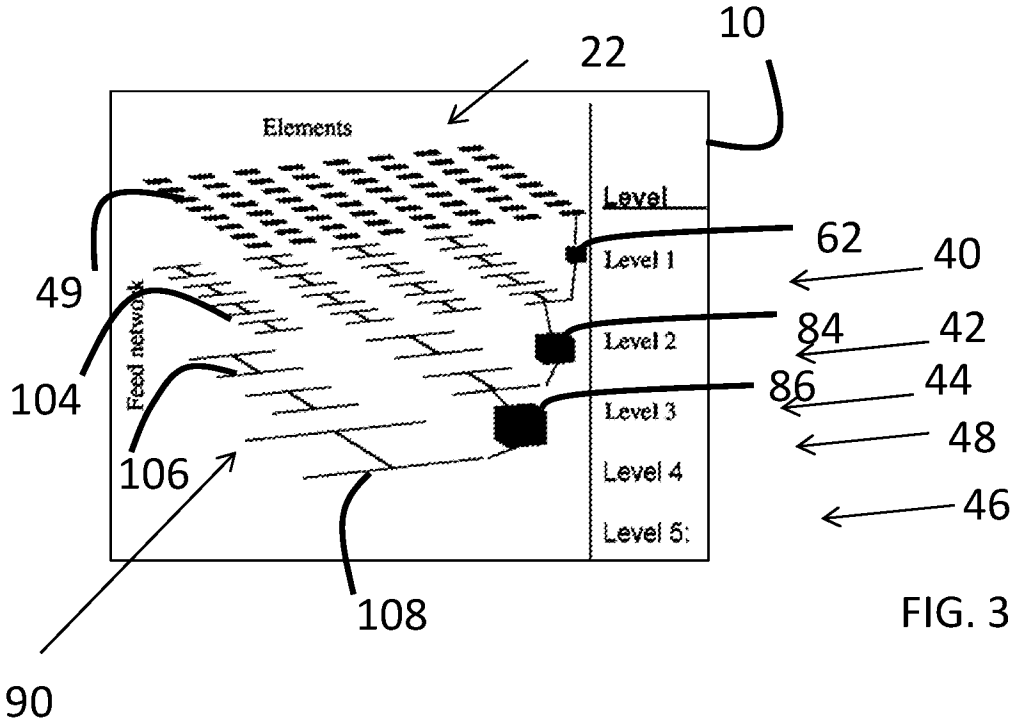
FIG. 3 is an electrical schematic drawing of the antenna system illustrated in FIG. 1 showing a hierarchical architecture according to exemplary aspects of the inventive concepts disclosed herein.
Figure 4:
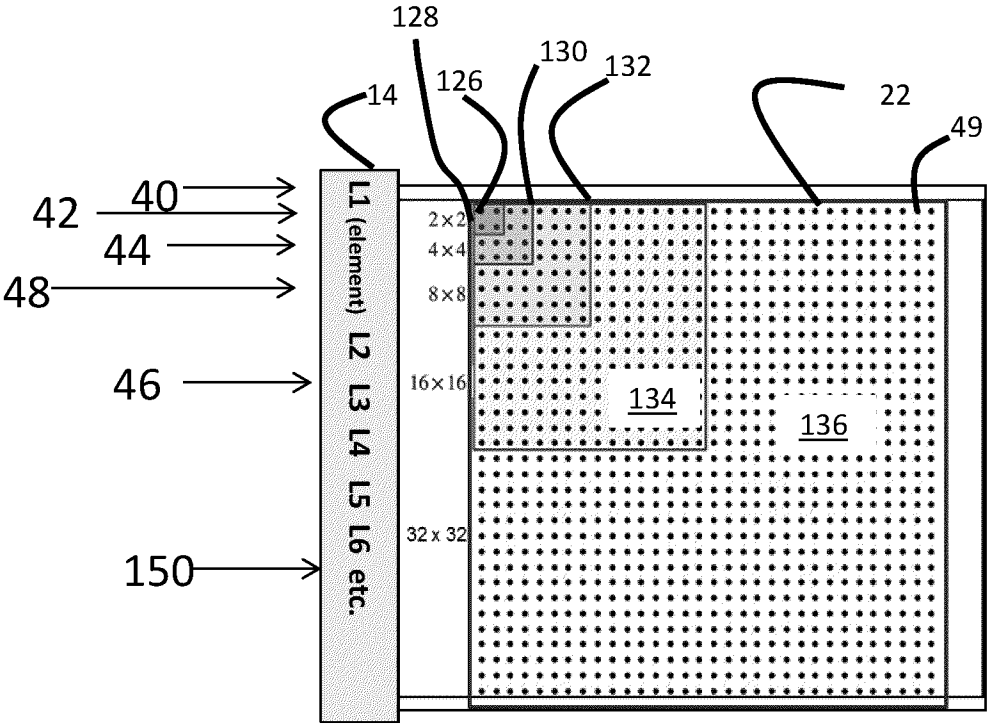
FIG. 4 is a top view schematic drawing a portion of an antenna array of the antenna system illustrated in FIG. 1 coupled to a feeder network shown in block diagram form according to exemplary aspects of the inventive concepts disclosed herein.

The antenna elements 49 are rectangular-shaped, linear, or bow-tie shaped conductive regions on circuit boards. Other shapes of antenna elements 49 can be utilized including but not limited to circular regions, pentagonal regions, hexagonal regions, square shaped regions, etc. The number of the antenna elements 49 can vary according to design criteria and system parameters. The antenna elements 49 can be tightly coupled dipole arrays (TCDA) and can be slot antennas (e.g., metal cut-outs) or other structures. The number, size, polarization, and shape of the antenna elements 49 are shown in FIGS. 2-4 in an exemplary fashion.

In some embodiments, the antenna elements 49 are arranged as a wavelength scaled array which allows radio lattice density realization via a predefined lattice relaxation factor (LRF). The LRF for the array 22 can vary in accordance with system parameters and designed criteria. The layout of the arrays 22 can be optimized with respect to size. In some embodiments, the antenna elements 49 are provided on a single circuit board or on multiple circuit boards (e.g., tiles) that are joined together to form the antenna array 22 according to U.S. patent application Ser. No. 15/825,711, U.S. Patent Publication No. 2017-0054221, and U.S. application Ser. No. 16/008,983 incorporated herein by reference.

The feed circuits, feed layers or feeder levels 40, 42, 44, 46 and 48 provide connections as well as processing for the signals received and transmitted on the antenna array 22. The connection between an antenna element 49 and a given feed port associated with the signal line 18 (FIG. 1) within a level is a series of cascade connections of level one phase shifters, summers, time delay units, more summers, etc. As signals progress through the layers 40, 42, 44, 46 and 48, the signals are summing and time delayed in subarray increments, where each subarray is comprised of previously summed subarrays. In some embodiments, the feeder level 40 of the feed network 14 includes a phase shifter for each antenna element 49 in the array 22. For example, an antenna element 50 is coupled to a phase shifter 60, an antenna element 52 is coupled to a phase shifter 62, an antenna element 54 is coupled to a phase shifter 64, and an antenna element 56 is coupled to a phase shifter 66. All elements 49 are coupled to a respective phase shifter in a similar fashion in the feeder level 40. In the some embodiments, the phase shifters 60, 62, 64, and 66 provide analog beam forming functions. In some embodiments, the phase shifter 60, 62, 64 and 66 are modulo 360 analog phase shifters.

The feeder level 42 includes a summer similar to a summer 72 coupled to each subarray associated with four phase shifters similar to the phase shifters 60, 62, 64, and 66 in the level 40. A time delay unit 84 is coupled to the summer 72 to provide a time delay. A time delay unit similar to the time delay unit 84 is coupled to each summer in the level 42. In the some embodiments, the feeder level 42 provides analog beam forming or digital beam forming functions.

The feeder level 44 includes a summer similar to a summer 74 coupled to each subarray associated with four summers (similar to the summer 72). A time delay unit 86 is coupled to the summer 74. A similar time delay unit is coupled to a similar summer similar to the summer 74 in some embodiments.

The feeder level 48 includes a summer similar to a summer 76 coupled to each subarray associated with four summers (similar to the summer 74). A time delay unit 88 is coupled to the summer 76 to provide a time delay. A similar time delay unit is coupled to a similar summer for each summer (similar to the summer 76) in the feeder level 44 in some embodiments.

The feeder level 46 includes a summer similar to a summer 78 coupled to each subarray associated with four summers (similar to the summer 76). A time delay unit can coupled to the summer 78 to provide a time delay. In some embodiments, the feeder level 46 and subsequent feeder levels do not include time delay units and are not coupled to a control bus.

In some embodiments, the feeder levels 40, 42, 44, 46, and 48 can include components described in U.S. U.S. Pat. No. 9,653,820, entitled "Active Manifold System and Method for an Array Antenna". In some embodiments, the summers 72, 74, 76, and 78 may include active combiners such as those described in U.S. Pat. No. 9,653,820, entitled "Active Manifold System and Method for an Array Antenna," and U.S. Pat. No. 9,735,469, entitled "Integrated Time Delay Unit System and Method for a Feed Manifold". The number of summers 72, 74, 76, and 78 discussed above are exemplary only. The subarray sizes can vary according to design parameters. The summers 72, 74, 76, and 78 are arranged in various fashions to communicate signals between the elements 49 and the signal line 18. The summers 72, 74, 76, and 78 are passive elements in some embodiments.

The phase shifters 60, 62, 64, and 66 of the level 40 effect a set of phase shifts or phase delays so that appropriate constructive interference is obtained. The phase shifters 60, 62, 64, and 66 have analog-like behavior to overcome quantization and white noise excitation for low side bands in one embodiment. In some embodiments, the phase shifters 60, 62, 64, and 66 are provided an on RF IC with on chip temperature and power sensors and have a response time on the order of 10 nanoseconds or less. The phase shifters 60, 62, 64, and 66 are included in active splitters/combiners described in U.S. application Ser. No. 14/300,074, now U.S. Pat. No. 9,653,820, filed on Jun. 9, 2014 by West et al. herewith, and entitled "Active Manifold System and Method for an Array Antenna," according to some embodiments.

The phase shifters 60, 62, 64, and 66 can be ferrite phase shifters and PIN diode phase shifters. The phase shifters 60, 62, 64, and 66 are digitally controlled phase shifters and can be single ended, or differential in certain embodiments. In some embodiment, the phase shifters 60, 62, 64, and 66 are 10 bit vector modulator phase shifters using silicon germanium (SiGe) RF integrated circuit technology.

The time delay units 84, 86, and 88 of the levels 40, 42, and 44 effect time delays or phase delays so that appropriate coherent time summation of the Information Band Width of the signal is obtained to prevent pulse dispersion, error vector magnitude (EVM) degradation, etc. A set of control signals or commands can be provided from the beam control computer 16 to control inputs on time delay units 84, 86, and 88 of the levels 40, 42, and 44. The control commands set the appropriate time delays for the time delay units 84, 86, and 88 of the levels 40, 42, and 44 to point the antenna system 10 at a pointing angle. The time delay units 84, 86, and 88 of the levels 40, 42, and 44 can have selectable circuit paths for implementing the appropriate time delay. In some embodiments, the time delay units 84, 86, and 88 of the levels 40, 42, and 44 are integrated circuit and circuit board time delay units as described in U.S. Pat. No. 9,735,469, incorporated herein by reference in its entirety.

With reference to FIGS. 2 and 3, the array 22 of the antenna elements 49 is shown with a hierarchical association with the feeder levels 40, 42, 44, 46 and 48. The feeder level 40 is coupled to each of the antenna elements 49 in the array 22 via phase shifters, such as the phase shifter 62 The feeder level 42 includes a set of 16 network elements 104 (e.g., sixteen summers 72 and time delay units 84 coupled to subarrays of 2 by 2 antenna elements 49). The feeder level 44 includes a set of four network elements 106 (e.g., four summers 74 and four time delay units 86 coupled to subarrays of 2 by 2 network elements 104). The feeder level 48 includes one network element 108 (e.g., a summer 76 and time delay unit 88 coupled to subarrays of 2 by 2 network elements 106.

With reference to FIG. 4, the array 22 of antenna elements 49 shows the association of levels 40, 42, 44 and 46 to regions 126, 128, 130, 132, 134, and 136 of the array 22. A feeder level 150 is associated with all of the antenna elements 49 in the array 22 represented by the region 136 of 1024 antenna elements 49. The feeder level 46 is associated with all of the antenna elements 49 in the array 22 as four quadrants, where one of the quadrants of 256 antenna elements 49 is represented by the region 134 (e.g., a top quadrant of the array 22 of the antenna elements 49). The feeder level 48 is associated with each antenna element 49 in the array 22 as sixteen regions, where one of the sixteen regions of sixty four antenna elements 49 is represented by the region 132. The feeder level 44 is associated with sixty four regions of sixteen antenna elements 49 as represented by the region 130. The feeder level 42 is associated with 256 sets of four antenna elements 49 as represented by region 130, and the feeder level 40 is associated with sets of one antenna element 49 as represented by the region 128.

In some embodiments, the level 40 includes phase shifters and the subsequent feeder levels 42, 44, and 46 are arranged hierarchically and include time delay units. In some embodiments, the phase shifters are configured for operation at the RF (e.g., centered at the carrier frequency) or at an intermediate frequency (e.g., after a first down conversion). In some embodiments, the feeder level 40 is for post intermediate frequency signals and the subsequent feeder levels 42, 44, and 46 are arranged hierarchically and include time delay units. In some embodiments, the feeder level 40 includes a phase shifter and middle levels (e.g., feeder level s 42 and 44) are arranged hierarchically and include time delay units and lower levels (e.g., feeder level 46) utilize hybrid digital beamforming. In some embodiments, the feeder level 40 is a post-IF level including time delay units as opposed to phase shifters, the mid-levels are hierarchically arranged and include time delay units, and lower levels use hybrid digital beamforming. In some embodiments, the feeder levels 40, 42, and 44 are hierarchically arranged and include time delay units, and the feeder level 46 includes direct digital beamforming. In some embodiments, the feeder level 40 includes a phase shifter and mid-levels (e.g., feeder levels 42 and 44) are hierarchically arranged and include time delay units and lower levels (e.g., feeder level 46) utilizes direct digital beamforming. In some embodiments, the digital beam forming is performed as close as possible to the radiating as radiating element lattice spacing, SWAP-C, DC power consumption, thermal management, etc., allow. Advantageously, the transition between signal beam forming and analog beam forming is readily accommodated relative to the above mentioned constraints due to the hierarchically arranged architecture. Digital hardware and software technology advances will allow closer disposition with respect to the radiating elements in some embodiments.

In some embodiments, the feeder level 40 utilizes post-IF phase shifting and middle levels (e.g., feeder levels 42 and 44) are hierarchically arranged levels with time delay units, and lower levels (e.g., feeder levels 46) utilize direct digital beamforming. In some embodiments, the feeder level 40 utilizes post-IF time delay units, middle levels (e.g., the feeder levels 42 and 44) use hierarchically arranged time delay units and lower levels (e.g., the feeder level 46) utilize direct digital beamforming. In some embodiments, direct digital beamforming involves directly sampling the RF signal and representing the signal as I/Q baseband signals for further digital signal processing. In some embodiments, the hybrid digital beam forming involves an analog RF conversion to an IF signal which is direct sampled and represented as a baseband I/Q signal for further digital signal processing. In some embodiments, the feeder level 40 is for analog or digital phase shifting of post intermediate frequency signals and the subsequent feeder levels 42, 44, and 46 are arranged hierarchically and include time delay units.

With reference to FIG. 4, in some embodiments, the feeder level 40 utilizes a modulo-360 degree phase shift at the antenna element level, the feeder level 42 includes sets of two by two regions coupled to a time delay unit, the feeder level 44 includes sets of four by four regions coupled to a time delay unit, the feeder level 44 is associated sets of eight by eight antenna elements 49 coupled to time delay units and subsequent layers (levels 48, 46, etc.) include a summer without a time delay unit or a phase shifter.

The array aperture lattice is constrained in (x,y,z) for proper operation as a function of frequency. These absolute dimensional constraints directly impact RFIC die size, RFIC package size, electrical interconnect, thermal conduction paths, etc. The use of the module-360 phase shifter reduces the constraints associated with using a time delay due to lattice size restrictions. The remaining delay is distributed utilizing time delay units in the feeder levels 42, 44, and 46. Each of feeder levels 42, 44, and 46 has a specific time delay growth factor set to the maximum delay in each layer below the elemental level (e.g., a max time delay is specified for each level and the number of bits are specified for each level). In some embodiments, feeder levels 42, 44, and 46 can be designed for pseudo aperiodicity to randomize amplitude and delay or phase quantization errors for improved performance. In some embodiments, the antenna system 10 achieves very low side low levels with no beam squint across a form by one instantaneous bandwidth (such as a bandwidth between 15 gigahertz and 60 gigahertz). The time delay units are analog time delay units in some embodiments. In some embodiments, the number of levels is seven.

It will be appreciated that the various ESAs described herein, including the antenna system 10, may include varying arrangements of antennas. In some embodiments, the subarrays of antennas are provided to form a three-dimensional array, which can be made conformal to a three-dimensional surface, such as a surface of an airborne platform. The number of the feeder levels 42, 44, 46, 48, and 150 can vary according to design criteria and system parameters and can correspond to the number of the antenna element regions 126, 128, 130, 132, 134, and 136. In some embodiments, the layer-to-layer reduction factor is general and is not restricted to a factor of four, the subarray element count of the subarrays is not restricted to be a power of two, and the layer-to-layer reduction factor can change as downward progress is made through the layers or levels from the elements toward the output port.

The construction and arrangement of the systems and methods as shown in the various exemplary embodiments are illustrative only. Other numbers or types of antenna elements, other polarization configurations and other numbers or types of dipole elements can be used. Although only a number of embodiments have been described in detail in this disclosure, many modifications are possible (e.g., variations in sizes, dimensions, structures, shapes and proportions of the various elements, values of parameters, orientations, etc.). For example, the position of elements may be reversed, flipped, or otherwise varied and the nature or number of discrete elements or positions may be altered or varied. Accordingly, all such modifications are included within the scope of the inventive concepts disclosed herein. The order or sequence of any operational flow or method operations may be varied or re-sequenced according to alternative embodiments. Other substitutions, modifications, changes, and omissions may be made in the design, operating conditions and arrangement of the exemplary embodiments without departing from the scope of the inventive concepts disclosed herein.

What is claimed is:

1. An antenna system with a hybrid beam former architecture, comprising:

a matrix of antenna elements; and a feeder network comprising:

a first level comprising phase shifters, wherein each of the phase shifters is for a respective antenna element of the antenna elements, wherein the first level and the matrix form a first layer;

a second level comprising a first set of first time delay units associated with first subarrays of the antenna elements, wherein each of the first set of the first time delay units is for a respective first subarray of the first subarrays of the antenna elements, wherein the second level forms a second layer adjacent to and in communication with the first layer; and a third level comprising a second set of second time delay units associated with second subarrays, wherein each of the second set of the second time delay units is for a respective second subarray of the second subarrays of the first subarrays, wherein the third level forms a third layer adjacent to and in communication with the second layer; and a fourth level comprising a third set of third time delay units associated with third subarrays, wherein each of the third set of the third time delay units is for a respective third subarray of the third subarrays of the second subarrays, wherein the fourth level forms a fourth layer adjacent to and in communication with the third layer, wherein phase shifters are absent in the second level, the third level, and the fourth level, wherein the first layer, the second layer, the third layer, and the fourth layer, are arranged sequentially in a respective layered stack.

2. The system of claim 1, further comprising a receiver, a transmitter, or a receiver/transmitter having a signal line coupled through the first time delay units, the second time delay units and the phase shifters to the antenna elements.

3. The system of claim 2, wherein the phase shifters are analog modulo 360 degree phase shifters.

4. The system of claim 1, wherein digital beamforming is performed in the fourth level.

5. The system of claim 1, wherein the first time delay units, the second time delay units, and the third time delay units are in a hierarchically layered arrangement.

6. The system of claim 5, wherein digital beamforming is performed in the third level.

7. The system of claim 1, wherein direct digital sampled beamforming is performed in the third level.

8. The system of claim 1, further comprising a fifth level, the fifth level comprising one or more summers coupled to one or more third time delay units, wherein the fifth level forms a fifth layer adjacent to and in communication with the fourth layer.

9. A method of beam forming using an electronically scanned antenna array, the method comprising:

providing phase shift commands to phase shifters respectively coupled to antenna elements of the electronically scanned antenna array;

providing first time delay commands to first time delay units, each of the first time delay units being associated with a respective first set of the antenna elements;

providing second time delay commands to second time delay units, each of the second time delay units being associated with a second set of first sets of the antenna elements; and providing third time delay commands to third time delay units, each of the third time delay units being associated with a third set of second sets of the antenna elements; wherein the first time delay units, the second time delay units, and the third time delay units, are disposed in a hierarchically layered arrangement such that the first time delay units, the second time delay units, and the third time delay units are each disposed on respective adjacent layers of the electronically scanned antenna array.

10. The method of claim 9, wherein the phase shifters are analog modulo 360 phase shifters.

11. The method of claim 10, wherein the first set of antenna elements is associated with one fourth of a number of antenna elements of the second set of the first sets of the antenna elements.

12. The method of claim 11, further comprising: converting signals from the second time delay units to a digital domain for digital beam forming.

13. The method of claim 9, further comprising:

down converting signals from the second time delay units to an intermediate frequency; and converting the signals after the down converting to a digital domain for digital beam forming.

14. The method of claim 9, further comprising:

converting signals to a digital domain for direct sampled digital beam forming.

15. A system for steering an antenna array, the system comprising:

a beam steering computer; and a hierarchical layered feeder network comprising:

a first level comprising phase shifters, wherein each of the phase shifters is for a respective antenna element of the antenna elements, wherein the first level and a matrix form a first layer;

a second level comprising a first set of first time delay units associated with first subarrays of the antenna elements, wherein each of the first time delay units of the first set of the first time delay units is for a respective first subarray of the first subarrays of the antenna elements, wherein the second level forms a second layer adjacent to and in communication with the first layer; and a third level comprising a second set of second time delay units associated with second subarrays, wherein each of the second time delay units of the second set of the second time delay units is for a respective second subarray of the second subarrays of the first subarrays; and a fourth level comprising a third set of third time delay units associated with third subarrays, wherein each of the third set of the third time delay units is for a respective third subarray of the third subarrays of the second subarrays, wherein the fourth level forms a fourth layer adjacent to and in communication with the third level, wherein phase shifters are absent in the second level, the third level, and the fourth level, wherein the first layer, the second layer, the third layer, and the fourth layer, are arranged sequentially in a respective layered stack.

16. The system of claim 15, wherein the antenna array is utilized with a receiver, transceiver or transmitter having a frequency range between 15 gigahertz and 60 gigahertz.

17. The system of claim 16, wherein the first subarray is associated with one fourth of a number of antenna elements of the second subarray and the second subarray is associated with one fourth of a number of antenna elements of a third subarray of a fourth level.

18. The system of claim 15, wherein the hierarchical layered feeder network includes a set of N summers in the second level, where N equals the number of antenna elements divided by four, wherein a respective first time delay unit of the first time delay units is coupled to each of the N summers.

19. The system of claim 18, wherein the hierarchical layered feeder network includes a set of M summers in the third level, where M equals N divided by four, wherein a respective second time delay unit of the second time delay units is coupled to each of the M summers.

* * * * *